US005402587A

United States Patent [19]

Buschbacher

[11] Patent Number: 5,402,587

[45] Date of Patent: Apr. 4, 1995

[54] HINGED FLEXIBLE WALKER ASSEMBLY

[76] Inventor: Ralph Buschbacher, 5163 Clear Lake Ct., Carmel, Ind. 46032

[21] Appl. No.: 195,161

[22] Filed: Feb. 10, 1994

[51] Int. Cl.[6] ..... A61H 3/00

[52] U.S. Cl. ..... 135/67; 297/5; 280/87.021

[58] Field of Search ..... 135/65, 66, 67, 74; 482/66, 68, 69; 297/5-7; 280/87.021, 87.051

[56] References Cited

U.S. PATENT DOCUMENTS

| | | | |
|---|---|---|---|
| 679,468 | 7/1901 | Pratt . | |
| 2,656,874 | 10/1953 | Robb . | |
| 2,738,830 | 3/1956 | Black . | |
| 3,165,112 | 1/1965 | Ries . | |
| 3,176,700 | 4/1965 | Drury, Jr. . | |
| 3,199,521 | 8/1965 | Ries . | |
| 3,199,886 | 8/1965 | Dover . | |
| 3,387,617 | 6/1968 | Reiber . | |
| 3,716,067 | 2/1973 | Skoog | 297/6 X |
| 3,731,698 | 5/1973 | Buchalter . | |
| 4,106,521 | 8/1978 | Thomas | 135/67 |
| 4,332,399 | 6/1982 | Kepple . | |
| 4,708,154 | 11/1987 | Edwards . | |
| 4,742,838 | 5/1988 | Muiza et al. . | |
| 4,748,994 | 6/1988 | Schultz et al. | 135/67 |
| 4,777,973 | 10/1988 | Nakajima . | |
| 4,830,035 | 5/1989 | Liu | 135/67 |
| 5,188,139 | 2/1993 | Garelick | 135/67 |
| 5,255,696 | 10/1993 | Leonard | 135/67 |
| 5,263,506 | 11/1993 | Narramore | 135/67 |

*Primary Examiner*—Lanna Mai
*Attorney, Agent, or Firm*—Locke Reynolds

[57] ABSTRACT

A walker assembly for assisting walking movement, includes a first side rail assembly having a first gripping rail configured to be manually grasped, a second side rail assembly having a second gripping rail configured to be manually grasped, and a connecting rail attached between the first and second side rail assemblies. A first leg assembly is pivotally connected to the first side rail assembly and a second leg assembly is pivotally connected to the second side rail assembly, with pivotal movement of the first and second leg assemblies made independent of each other. The assembly further includes a mechanism for constraining pivotal movement of the respective first and second side rail assembly and the first and second leg assembly.

6 Claims, 1 Drawing Sheet

HINGED FLEXIBLE WALKER ASSEMBLY

BACKGROUND AND SUMMARY OF THE INVENTION

The present invention relates to a walker or cane for assisting and supporting walking movement. More particularly, the present invention relates to a hinged or flexible walker assembly or cane assembly.

Adjustable walkers for use in conjunction with stairs, steps, and the like are known in the prior art. For example, both U.S. Pat. No. 3,387,617 to Reiber and U.S. Pat. No. 3,176,700 to Drury, describe a walker having two adjustable front legs that can be telescopically extended or retracted, and locked into position to aid in descent or ascent of stairs. This concept is further developed in U.S. Pat. No. 4,777,973 to Nakajima, which describes independently extensible or retractable front and rear legs. However, in all these designs extension or retraction occurs co-linear to the main shaft, and the legs are not assured of maintaining a substantially perpendicular position with respect to the ground on uneven surfaces or terrain.

In an attempt to reduce the energy required to use walkers, and to compensate for sloping terrain, walker designs in which the rear and front legs are pivotally movable with respect to each other have been disclosed. For example, U.S. Pat. No. 2,656,874 to Robb discloses such a simple spring assisted walker, while U.S. Pat. No. 4,742,838 to Muiza et al. discloses a more advanced swinging leg walker system. However, these systems still do not simulate certain aspects of normal walking, including dorsiflexion and plantar flexion of a foot, and do not permit substantially perpendicular orientation of the legs with respect to the ground under varying terrain conditions.

What is needed is a hinged or flexible walking assist device that simulates dorsiflexion and plantar flexion of a foot, thereby improving speed and comfort of a walker using a walking assist device. In addition, such a hinged or flexible walking assist device operates in varying terrain conditions by adapting the position of the legs to remain substantially perpendicular to the ground, increasing the balance of a user, and increasing speed and security of walking for the user. The present invention satisfies these needs by provision of a walker assembly for assisting walking movement, with the walker assembly including a first side rail assembly having a first gripping rail configured to be manually grasped and a second side rail assembly having a second gripping rail configured to be manually grasped. At least one connecting rail is attached between the first and second side rail assemblies.

A first leg assembly is pivotally connected to the first side rail assembly and a second leg assembly is pivotally connected to the second side rail assembly, with pivotal movement of the first and second leg assemblies normally being independent of each other. Optionally, a first mechanism constrains pivotal movement of the first side rail assembly and the first leg assembly. In one preferred embodiment, an elastic element such as a cord, tension, or built-in, hinge-mounted circular spring having a predetermined spring constant is attached, typically between the first side rail assembly and the first leg assembly, to limit the permissible rotation of the first side rail with respect to the first leg assembly. Similarly, a second mechanism constrains pivotal movement of the second side rail assembly and the second leg assembly. Again, in a preferred embodiment an elastic element is attached between the second side rail assembly and the second leg assembly to limit rotation of the second side rail with respect to the second leg assembly. As will be appreciated, additional, secondary elastic elements or friction devices can also be employed to provide a biased forced counteracting a primary elastic element. The spring constants of these elastic elements can optionally be adjusted to alter the tilt of the upper portion of the walker with respect to the leg assembly when the walker is used. In addition, in preferred embodiments, the first leg assembly has a front leg integrally attached to a back leg, and the second leg assembly similarly includes a front leg integrally attached to a back leg, with this integral connection effectively increasing rigidity and stability of the walker assembly.

In an alternative embodiment of the present invention, a walker assembly for assisting walking movement includes a side rail assembly having a gripping rail configured to be manually grasped, with the side rail assembly constructed to form a rigid unit when used. A dual leg assembly having front and backs legs is rigidly connected to each other, with the dual leg assembly pivotally connected to the side rail assembly. Also provided in this embodiment is a mechanism that pivotally connects the dual leg assembly to the side rail at least at one hinge point to allow pivoting movement of the dual leg assembly with respect the side rail assembly. Of course, as those skilled in the art will appreciate, multiple hinge or other pivoting linkage mechanism can also be used in the present invention to provide the required pivoting motion. In addition, this pivoting motion of the side rail assembly can be constrained by provision of elastic cords, compression or tension springs, leaf springs, plastic bumpers, or other mechanisms known to those skilled in the art to dynamically limit movement. For certain embodiments, it is possible to lock or otherwise disable action of the elastic cords, springs, bumpers, etc., to lock the walker into a fixed, rigid position. In particularly preferred embodiments, a constraining mechanism such as an elastic element limits rotation of the side rail assembly with respect to the dual leg assembly to about a 20 degree arc. Of course, as required the rotation limit can be adjusted to permit greater or lesser rotation of the side rail assembly.

Yet another alternative embodiment of the present invention provides a walker assist device for aiding walking movement that includes a grip assembly configured to be manually grasped. An upper shaft is rigidly configured and connected to the grip assembly, and a lower shaft is pivotally connected to the upper shaft. A leg assembly is connected to the lower shaft for ground contact. The pivotal connection can include constrained mechanical hinge type connections, or may include a flexible link attached between the upper shaft and the lower shaft, with the flexible link configured to elastically bend. This latter arrangement is particularly useful for use in conjunction with canes.

Additional objects, features, and advantages of the present invention will be apparent upon consideration of the following detailed description and accompanying drawings.

DETAILED DESCRIPTION OF THE INVENTION

Figure 1:
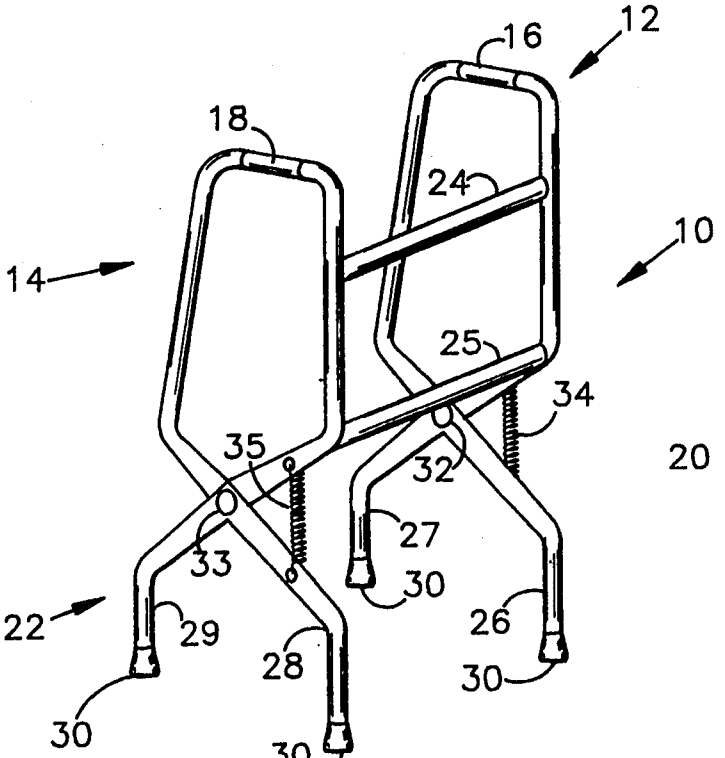
FIG. 1 is a perspective view of a walker assembly in accordance with the present invention, illustrating upper side rails pivotally connected to leg assemblies.

As illustrated in FIG. 1, a hinged walker assembly 10 includes first and second side rail assemblies 12 and 14. The rail assemblies 12 and 14 in turn respectively include first and second gripping rails 16 and 18 for manual grasping by a person in need of walking assistance. The first side rail assembly 12 is permanently attached by connecting rails 24 and 25 to the second side rail assembly 14. This arrangement unites the rail assemblies 12 and 14 into a single structure capable of moving in unison. The assemblies 12 and 14, as well as connecting rails 24 and 25, should be lightweight and easily manufactured, and are typically constructed using tubular elements of aluminum, steel, or engineering grade polymers that provide a sturdy, rigid, and low cost portable structure. As will be appreciated by those skilled in the art, it is possible to augment the illustrated walker by provision of hinged side or connecting rails that permit folding of the walker for storage purposes.

As illustrated, the first side rail assembly 12 is independently attached to a first leg assembly 20 by a pivotal connector 32. As illustrated, the pivotal connector 32 is simply a ball hinge that rotatably links the first side rail assembly 12 and the first leg assembly 20. As will be appreciated by those skilled in the art, alternative types of linking hinges may also be employed, such as pivot pins, ball bearing supported hinges, sliding bearing surfaces, or the like. The degree of arc through which the first side rail assembly 12 can rotate with respect to the first leg assembly 20 is constrained by a separately attached pivot constraint spring 34 that limits rotation of the first side rail assembly 12 by urging the side rail assembly 12 to rotate to a perpendicular position with respect to the ground. Alternative constraint mechanisms are also possible, with hinges having integrally defined spring systems being contemplated, as well as elastic cords or straps, friction constraint, or other known mechanisms for limiting and cushioning pivotal movement.

As is apparent from consideration of FIG. 1, connection of the second side rail assembly 14 to a second leg assembly 22 is substantially identical in form and function to the previously described pivotal connection between the first side rail assembly 12 and first leg assembly 20. The second side rail assembly 14 is independently attached to a second leg assembly 22 by a pivotal connector 33. Again, the pivotal connector 33 is a ball hinge that passes through a portion of the second side rail assembly 14 and the second leg assembly 22 to rotatably link the two assemblies. The degree of arc through which the second side rail assembly 14 can rotate with respect to the second leg assembly 22 is constrained by a separately attached pivot constraint spring 35 that limits rotation of the second side rail assembly 14 by urging the side rail assembly 14, and the integrally connected side rail assembly 12, to rotate to a perpendicular position with respect to the ground. Typically, the rotational arc of the device is limited to about 20 degrees, although greater or lesser rotation (eg. 5 to 10 degrees, or 25 to 30 degrees) is also contemplated.

As will be appreciated by those skilled in the art, a wide variety of other mechanisms can be utilized to attach and constrain pivotal movement of the first or second side rail assemblies 12 and 14, including tension, compression, or leaf springs, elastic cords, hydraulic or pneumatic piston elements, friction resistance elements, or even simple mechanical stops. Single or multiple hinge points can be used, and alternate walker configurations (eg. tripod configuration) can be employed as necessary. In addition, pivot constraint using multiple elements, multiple attachment points of tension/compression elements, or dynamically opposing tension/-compression elements are also within the scope of the present invention. Optionally, over-ride locking mechanisms can also be provided to forcibly maintain the assembly in a fixed position if desired.

The leg assemblies 20 and 22 are of conventional design, respectively having front and back legs 26, 27 and front and back legs 28, 29. Each leg assembly is formed as a single unit, and moves independently of each other in operation. The legs terminate in separately affixed leg caps 30. The leg caps 30 are of conventional replaceable design, typically being height adjustable and constructed from a skid resistant and shock absorbing polymeric material.

Figure 3:
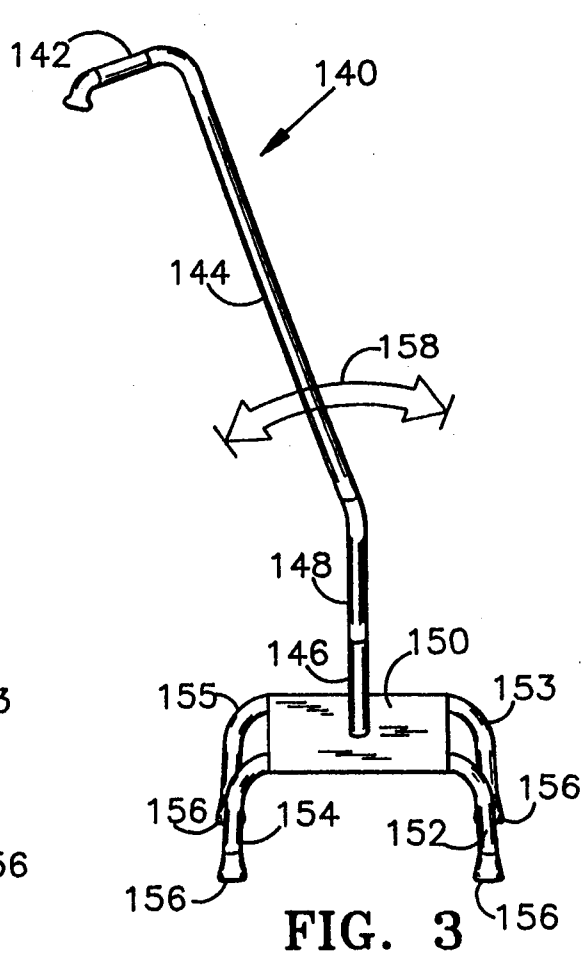
FIG. 3 is a perspective view of an alternative cane-type walk assist device having an intermediary flexible shaft connecting an upper and a lower shaft.
Figure 2:
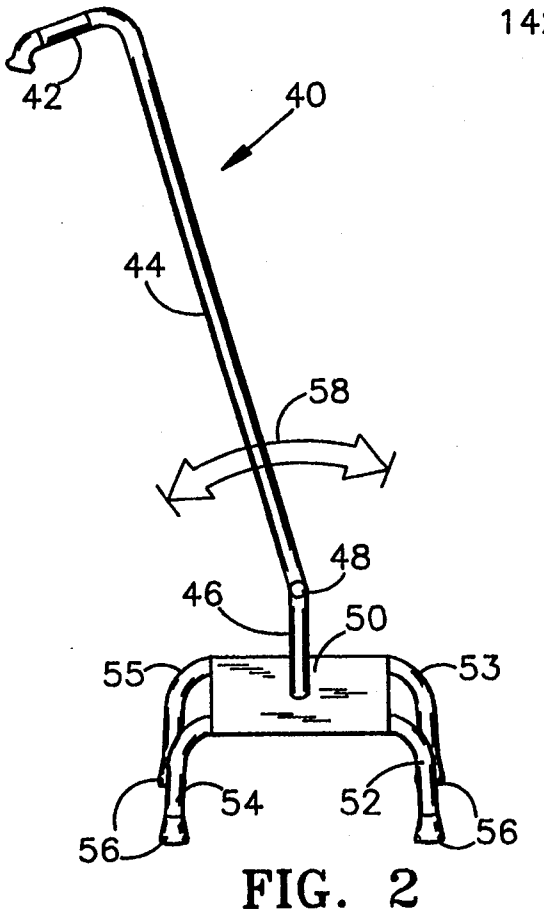
FIG. 2 is a perspective view of a cane-type walk assist device having an optionally lockable intermediary spring hinge connection between an upper and a lower shaft.

Alternative walking assist devices similar to traditional canes are illustrated in FIGS. 2 and 3. As shown in FIG. 2, a hinged cane assembly 40 includes a handle 42 connected to a rigid, tubular upper shaft 44. The upper shaft 44 is pivotally connected by a spring hinge 48 to a lower shaft 46. The lower shaft 46 extends upward from its attachment to a leg attachment platform 50. The leg attachment platform 50 in turn supports front legs 52, 53 and back legs 54, 55. Each leg terminates in a conventional leg cap 56 such as previously described in connection with FIG. 1. As will be appreciated, the spring hinge 48 provides a pivotal connection that is biased to return the upper shaft 44 to a parallel orientation with respect to the lower shaft 46, while still allowing rotation of the upper shaft through an arc (represented by arrow 58). Optionally, the spring hinge 48 can be locked in a fixed position. In operation, and when unlocked, rotation of the shafts increases maneuverability and speed of a user, in part by providing smoother setdown of the walk assist device.

FIG. 3 illustrates a cane assembly 140 substantially equivalent to that illustrated in FIG. 2, with the noted exception of use of a flexible connecting shaft 148 that replaces spring hinge 48 of FIG. 2. When constructed of a resilient polymeric material having elastic properties, the shaft 148 is normally biased to return the upper and lower shafts 144, 146 to a parallel orientation. In operation, substitution of varying length shafts 148 permits control of the arc of rotation of the upper shaft 144 with respect to the lower shaft 146.

While the present invention has been described in connection with specific embodiments, it will be apparent to those skilled in the art that various changes may be made therein without departing from the spirit or scope of the invention.

I claim:

1. A walker assembly for assisting walking movement, the assembly comprising a side rail assembly having a gripping rail configured to be manually grasped, the side rail assembly unitarily constructed as a rigid unit, a dual leg assembly having front and backs legs rigidly connected to each other, with the dual leg assembly pivotally connected to the side rail assembly, means for pivotally connecting the dual leg assembly to the side rail at least at one hinge point to allow pivoting movement of the dual leg assembly with respect the side rail assembly, and spring means for flexibly constraining rotational movement of the side rail assembly with respect to the dual leg assembly.

2. The walker assembly of claim 1, wherein said spring means limits rotation of the side rail assembly with respect to the dual leg assembly to within about a 20 degree arc.

3. A walker assembly for assisting walking movement, the assembly comprising a first side rail assembly having a first gripping rail configured to be manually grasped, a second side rail assembly having a second gripping rail configured to be manually grasped, a connecting rail attached between the first and second side rail assemblies, a first leg assembly pivotally connected to the first side rail assembly and a second leg assembly pivotally connected to the second side rail assembly, with pivotal movement of the first and second leg assemblies independent of each other, and first springs mean for flexibly constraining pivotal movement of the first side rail assembly and the first leg assembly, the constraining means being attached between the first side rail assembly and the first leg assembly, and second spring means for flexibly constraining pivotal movement of the second side rail assembly and the second leg assembly, the second constraining means being attached between the second side rail assembly and the second leg assembly.

4. The walker assembly of claim 1, wherein the first leg assembly further comprises a front leg integrally attached to a back leg, and the second leg assembly further comprises a front leg integrally attached to a back leg.

5. A walker assembly for assisting walking movement, the assembly comprising a first side rail assembly having a first gripping rail configured to be manually grasped, a second side rail assembly having a second gripping rail configured to be manually grasped, a connecting rail attached between the first and second side rail assemblies, a first leg assembly pivotally connected to the first side rail assembly and a second leg assembly pivotally connected to the second side rail assembly, with pivotal movement of the first and second leg assemblies independent of each other, and first means for constraining pivotal movement of the first side rail assembly and the first leg assembly, the constraining means being attached between the first side rail assembly and the first leg assembly, with the first constraining means further comprising at least one elastic element attached between the first side rail assembly and first leg assembly, and second means for constraining pivotal movement of the second side rail assembly and the second leg assembly, the second constraining means being attached between the second side rail assembly and the second leg assembly to have at least one elastic element attached between the second side rail assembly and second leg assembly.

6. The walker assembly of claims 5, wherein both said at least one elastic elements are tension springs.

* * * * *